US010438726B1

(12) United States Patent
Cook et al.

(10) Patent No.: US 10,438,726 B1
(45) Date of Patent: Oct. 8, 2019

(54) COMMUNICATION CABLES INCORPORATING SEPARATORS WITH LONGITUDINALLY SPACED RADIAL RIDGES

(71) Applicant: Superior Essex International LP, Atlanta, GA (US)

(72) Inventors: Thomas Christopher Cook, Woodstock, GA (US); Amir Sekhavat, Marietta, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 15/624,832

(22) Filed: Jun. 16, 2017

(51) Int. Cl.
*H01B 11/04* (2006.01)
*H01B 11/08* (2006.01)
*H01B 7/02* (2006.01)

(52) U.S. Cl.
CPC ..... *H01B 11/08* (2013.01); *H01B 7/02* (2013.01)

(58) Field of Classification Search
CPC ..... H01B 11/04; H01B 11/06
USPC ..... 174/113 R, 113 C
See application file for complete search history.

(56) References Cited

U.S. PATENT DOCUMENTS

| | | | |
|---|---|---|---|
| 1,389,143 | A | 8/1921 | Kempton |
| 2,538,019 | A | 1/1951 | Edwin |
| 2,796,463 | A | 6/1957 | Mallindrodt |
| 3,090,825 | A | 5/1963 | Volk |
| 3,135,935 | A | 6/1964 | Eugelbrecht |
| 3,312,774 | A | 4/1967 | Drinko |
| 3,373,475 | A | 3/1968 | Peterson |
| 3,612,744 | A | 10/1971 | Thomas |
| 4,165,442 | A | 8/1979 | Gabriel |
| 4,604,497 | A | 8/1986 | Bell et al. |
| 4,638,272 | A | 1/1987 | Ive |
| 4,746,767 | A | 5/1988 | Gruhn |
| 4,784,462 | A | 11/1988 | Priaroggia |
| 4,807,962 | A | 2/1989 | Arroyo |
| 4,881,642 | A | 11/1989 | Adam |
| 5,006,806 | A | 4/1991 | Rippingale |
| 5,008,489 | A | 4/1991 | Weeks et al. |

(Continued)

FOREIGN PATENT DOCUMENTS

| | | |
|---|---|---|
| EP | 0915486 | 11/1998 |
| EP | 1632957 | 5/2005 |

(Continued)

OTHER PUBLICATIONS

US 5,955,445 A, 09/1999, Deitz et al. (withdrawn)

(Continued)

*Primary Examiner* — Chau N Nguyen

(57) ABSTRACT

A cable may include a plurality of twisted pairs of individually insulated conductors, a separator positioned between the twisted pairs, and a jacket formed around the twisted pairs and the separator. The separator may include a longitudinally extending spine positioned between the plurality of twisted pairs, and a plurality of projections extending from the spine with each projection extending between a set of adjacent twisted pairs. Additionally, a plurality of longitudinally spaced radial ridges may be incorporated into the separator. Each ridge may extend from a surface of one of the plurality of projections towards one of the plurality of twisted pairs in order to provide increased separation distance.

17 Claims, 5 Drawing Sheets

(56) References Cited

U.S. PATENT DOCUMENTS

| | | | | |
|---|---|---|---|---|
| 5,106,175 | A | 4/1992 | Davis et al. | |
| 5,114,517 | A | 5/1992 | Rippingale et al. | |
| 5,177,809 | A | 1/1993 | Zeidler | |
| 5,789,711 | A | 8/1998 | Gaeris | |
| 5,952,615 | A | 9/1999 | Prudhon | |
| 6,222,130 | B1 | 4/2001 | Gareis | |
| 6,248,954 | B1 | 6/2001 | Clark | |
| 6,288,340 | B1 | 9/2001 | Arnould | |
| 6,297,454 | B1 | 10/2001 | Gareis | |
| 6,310,295 | B1 | 10/2001 | Despard | |
| 6,365,836 | B1 | 4/2002 | Blouin | |
| 6,506,976 | B1 | 1/2003 | Neveux, Jr. | |
| 6,570,095 | B2 | 5/2003 | Clark et al. | |
| 6,596,944 | B1 | 7/2003 | Clark | |
| 6,624,359 | B2 | 9/2003 | Bahlmann | |
| 6,639,152 | B2 | 10/2003 | Glew | |
| 6,687,437 | B1 | 2/2004 | Starnes et al. | |
| 6,723,925 | B2 | 4/2004 | Ohara et al. | |
| 6,737,574 | B2 | 5/2004 | Sylvia et al. | |
| 6,770,819 | B2 | 8/2004 | Patel | |
| 6,800,811 | B1 | 10/2004 | Boucino | |
| 6,812,408 | B2 | 11/2004 | Clark et al. | |
| 6,850,161 | B1 | 2/2005 | Elliott | |
| 6,888,070 | B1 * | 5/2005 | Prescott | H01B 11/06 174/113 C |
| 7,098,405 | B2 | 8/2006 | Glew | |
| 7,135,641 | B2 | 11/2006 | Clark | |
| 7,173,189 | B1 | 2/2007 | Hazy et al. | |
| 7,179,999 | B2 | 2/2007 | Clark et al. | |
| 7,196,271 | B2 | 3/2007 | Cornibert | |
| 7,238,886 | B2 | 7/2007 | Wiekhorst et al. | |
| 7,329,815 | B2 | 2/2008 | Kenny et al. | |
| 7,332,676 | B2 | 2/2008 | Sparrowhawk | |
| 7,335,837 | B2 | 2/2008 | Pfeiler et al. | |
| 7,834,271 | B2 | 11/2010 | Gromko et al. | |
| 7,923,632 | B2 | 4/2011 | Smith et al. | |
| 7,964,797 | B2 | 6/2011 | Clark et al. | |
| 8,119,907 | B1 | 2/2012 | McNutt | |
| 8,313,346 | B2 | 11/2012 | Sparrowhawk | |
| 8,319,104 | B2 * | 11/2012 | Camp, II | H01B 11/04 174/113 C |
| 8,445,787 | B2 | 5/2013 | Nordin et al. | |
| 8,525,030 | B2 | 9/2013 | Wiekhorst et al. | |
| 8,558,115 | B2 | 10/2013 | Jenner et al. | |
| 8,624,116 | B2 | 1/2014 | Wiekhorst et al. | |
| 8,798,419 | B2 * | 8/2014 | Wessels, Jr. | H01B 11/125 385/113 |
| 9,136,043 | B2 | 9/2015 | Brown | |
| 9,336,928 | B2 | 5/2016 | Wiekhorst et al. | |
| 2003/0111241 | A1 | 6/2003 | Bahlmann | |
| 2003/0217863 | A1 | 11/2003 | Clark et al. | |
| 2003/0230427 | A1 | 12/2003 | Gareis | |
| 2004/0035603 | A1 | 2/2004 | Clark | |
| 2004/0055781 | A1 | 3/2004 | Cornibert | |
| 2006/0048961 | A1 | 3/2006 | Pfeiler et al. | |
| 2006/0131057 | A1 | 6/2006 | Lique | |
| 2007/0037419 | A1 | 2/2007 | Sparrowhawk | |
| 2007/0044995 | A1 | 3/2007 | Park | |
| 2007/0193769 | A1 | 8/2007 | Clark | |
| 2007/0224495 | A1 | 9/2007 | Gibbons et al. | |
| 2007/0275583 | A1 | 11/2007 | McNutt | |
| 2008/0255435 | A1 | 10/2008 | Al-Ali et al. | |
| 2008/0264670 | A1 | 10/2008 | Glew | |
| 2008/0314636 | A1 | 12/2008 | Ogura | |
| 2009/0173514 | A1 | 7/2009 | Gareis et al. | |
| 2010/0096179 | A1 | 4/2010 | Sparrowhawk et al. | |
| 2010/0218973 | A1 * | 9/2010 | Camp, II | H01B 11/06 174/113 C |
| 2011/0147039 | A1 | 6/2011 | Smith et al. | |
| 2013/0008684 | A1 | 1/2013 | Weitzel | |
| 2014/0262425 | A1 | 9/2014 | Hopkinson et al. | |
| 2015/0318075 | A1 | 11/2015 | Heffner et al. | |

FOREIGN PATENT DOCUMENTS

| | | |
|---|---|---|
| GB | 2432963 | 6/2007 |
| JP | 200009078 | 4/2000 |
| JP | 2004311120 | 11/2004 |
| JP | 2006173044 | 6/2006 |
| WO | WO2006105166 | 5/2006 |
| WO | WO2011020967 | 2/2011 |

OTHER PUBLICATIONS

Non-Final Office Action for U.S. Appl. No. 15/345,775, dated Jun. 26, 2017.
Notice of Allowance for U.S. Appl. No. 15/455,182, dated Jun. 28, 2017.
Notice of Allowance for U.S. Appl. No. 15/435,685, dated Aug. 10, 2017.
Non-Final Office Action for U.S. Appl. No. 15/227,390, dated Aug. 30, 2017.
Notice of Allowance for U.S. Appl. No. 15/227,385, dated Nov. 14, 2017.
Office Action for U.S. Appl. No. 15/252,775 dated Oct. 31, 2017.
Office Action for U.S. Appl. No. 15/345,775, dated Dec. 21, 2017.
Office Action for U.S. Appl. No. 15/277,390, dated Jan. 17. 2018.
Office Action for U.S. Appl. No. 15/252,775, dated May 30, 2018.
Notice of Allowance for U.S. Appl. No. 15/435,685, dated May 9, 2018.
Final Office Action for U.S. Appl. No. 15/435,685, dated Feb. 6, 2018.
"Product Catalogue" 2 pages, Enterprise Cabling R&M. May 2006.
"Draka" 12 pages, Draka Comtez, Cable Solutions, Data Cables, Sep. 27, 2006.
"10 Gigabit Ethernet Solutions" 8 pages, R&M Convincing Cabling Solutions.
Wetzikon, "R&M: THe Rising Stars in Copper Cabling" 2 pages, Sep. 1. 2005.
"R&M Star Real 10" 2 pages, Mar. 2006.
"Connections 29" 36 pages; Sep. 2005.
Pfeiler et al., U.S Pat. No. 7,335,837, issued Feb. 26, 2008.
Disclosure Statement Under 37 C.F.R. § 1.56, dated Jun. 22, 2017.
Non-Final Office Action for U.S. Appl. No. 15/345,775 dated Jul. 24, 2018.
Non-Final Office Action for U.S. Appl. No. 16/047,080 dated May 23, 2019.

* cited by examiner

COMMUNICATION CABLES INCORPORATING SEPARATORS WITH LONGITUDINALLY SPACED RADIAL RIDGES

TECHNICAL FIELD

Embodiments of the disclosure relate generally to communication cables and, more particularly, to communication cables incorporating separators with longitudinally spaced radial ridges.

BACKGROUND

A wide variety of different types of communications cables incorporate twisted pairs. In each pair, two conductors are twisted together in a helical fashion to form a balanced transmission line. Twisted pair cables may include shielded or unshielded twisted pairs ("UTP"), and twisted pair cables may be utilized in a wide variety of applications, such as Ethernet networks and telephone systems. When twisted pairs are placed in close proximity to one another, electrical energy may be transferred from one pair to another pair. Such energy transfer between pairs is undesirable and is referred to as crosstalk. Crosstalk may occur between twisted pairs in the same cable, or between twisted pairs of adjacent cables. Crosstalk causes interference to the information being transmitted through the twisted pairs and can reduce the data transmission rate and can cause an increase in bit rate error.

In order to reduce crosstalk between the twisted pairs in the same cable, it is desirable to provide separation between the twisted pairs. In many conventional cables, separators (also referred to as separation fillers, fillers, interior supports, or splines) have been positioned between the twisted pairs. Many conventional separators, such as conventional cross-filler separators, include continuous projections that extend between various sets of adjacent twisted pairs within a cable core to limit or prevent interlinking and/or crosstalk. However, continuous projections increase an amount of required material for a separator and reduce the overall flexibility of the separators and cables. In many cases, the continuous projections are also formed with a uniform minimum thickness, further contributing to material and/or flexibility issues. Accordingly, there is an opportunity for improved separator structures that include longitudinally spaced radial ridges, as well as for cables incorporating the separators.

Additionally, in certain cables (e.g., UTP cables, etc., twisted pairs in adjacent cables or cables in relatively close proximity to one another may be more susceptible to alien crosstalk. In order to mitigate the effects of alien crosstalk, it may be desirable to increase the separation distance between the cables. Conventionally, cable separation distances have been increased by utilizing a thicker cable jacket; however, thicker jackets increase the overall material costs and weight of the cable. Certain conventional cables have been formed in which ribs are formed on an internal surface of the jacket in order to increase the separation distance between adjacent cables. However, it may be possible for twisted pairs to shift or migrate into the gaps or spaces between adjacent ribs, thereby subjecting the pairs to increased alien crosstalk risks. Accordingly, there is an opportunity for improved cable designs that incorporate longitudinally spaced radial ridges that further assist in reducing alien crosstalk.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1A:
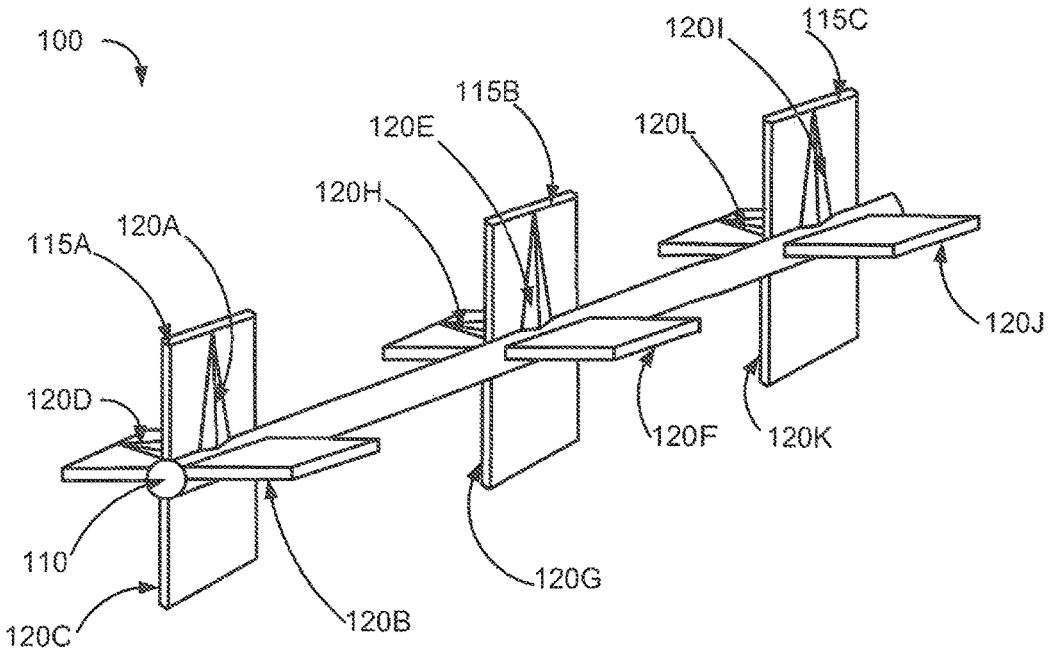
FIGS. 1A-1B are perspective views of example separators that include longitudinally spaced radial ridges, according to illustrative embodiments of the disclosure.

Various embodiments of the present disclosure are directed to twisted pair communication cables that incorporate separators including a plurality of longitudinally spaced radial ridges. The radial ridges may provide desired separation distance between one or more sets of adjacent twisted pairs and/or between one or more twisted pairs and an outer wrap. In one example embodiment, a cable may include a plurality of longitudinally extending twisted pairs of individually insulated conductors and a jacket or other suitable layer (e.g., a shield layer, etc.) formed around the plurality of twisted pairs. Additionally, a separator may be positioned between the plurality of twisted pairs. The separator may include a longitudinally extending portion, such as a central spine, that is positioned between the plurality of twisted pairs. Additionally, a plurality of projections may extend from the spine with each projection extending between a set of adjacent twisted pairs. In certain embodiments, the plurality of projections may include longitudinally spaced sets of projections. According to an aspect of the disclosure, one or more radial ridges may be formed on or extend from a surface of various projections. Each radial ridge may extend from a projection towards one of the plurality of twisted pairs.

A wide variety of suitable configurations of projections may be utilized as desired in various embodiments. In certain embodiments, longitudinally continuous projections may respectively extend from the spine between each set of adjacent twisted pairs. In other embodiments, a plurality of longitudinally spaced sets of projections may extend from the spine. For example, a respective set of projections may extend from each of a plurality of locations along a longitudinal length of the spine with longitudinal gaps or spaces between each adjacent set of projections. In yet other embodiments, projections may alternate in their direction of extension at a plurality of longitudinally spaced locations. A wide variety of other suitable configurations of projections may be utilized as desired.

According to an aspect of the disclosure, a plurality of longitudinally spaced radial ridges may be incorporated into the separator and formed on surfaces of the projections. For example, with longitudinally spaced sets of projections, one or more radial ridges may be formed on each projection. As another example, with relatively continuous projections, a plurality of longitudinally spaced radial ridges may be formed on each projection. Each radial ridge may be formed on a surface of a projection and extend away from the projection towards an adjacent twisted pair. In this regard, the radial ridge may increase a separation distance between the twisted pair and the projection, as well as between the twisted pair and other twisted pairs of a cable. Further, the use of spaced radial ridges may facilitate increased separation distances while reducing an amount of material required for a separator.

In certain embodiments, radial ridges may be formed in a clockwise or counterclockwise manner around an outer periphery of a separator. For example, respective radial ridges may be formed on respective first surfaces of various projections while no radial ridges are formed on the opposite surfaces of the projections. In other words, ridges may be formed on similar sides or surfaces of projections around an outer periphery of a separator. Additionally, in certain embodiments, corresponding ridges may be formed for each twisted pair at a given longitudinally spaced location. In other embodiments, radial ridges for various twisted pairs may be longitudinally spaced, staggered, or offset from one another along a longitudinal length of a separator.

Each radial ridge may be formed with a wide variety of suitable cross-sectional shapes and dimensions as desired in various embodiments. For example, a ridge may be formed with an approximately semi-circular, triangular, rectangular, trapezoidal, or other suitable cross-sectional shape as it extends from a projection. As another example, a radial ridge may be formed with any suitable width along a longitudinal direction. Additionally, a radial ridge may be formed with any suitable length along a distance of extension of a projection from a spine. In certain embodiments, a radial ridge may be continuous along a radial distance of extension of a projection. In other embodiments, a radial ridge may occupy only a portion of a projection's radial distance or a radial ridge may be formed with a plurality of sections that extend from a projection along the projection's radial distance of extension. Further, a radial ridge may be formed with any suitable thickness, such as a relatively continuous thickness or a thickness that tapers along the ridge. Indeed, a wide variety of suitable radial ridge configurations may be utilized as desired.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1B:
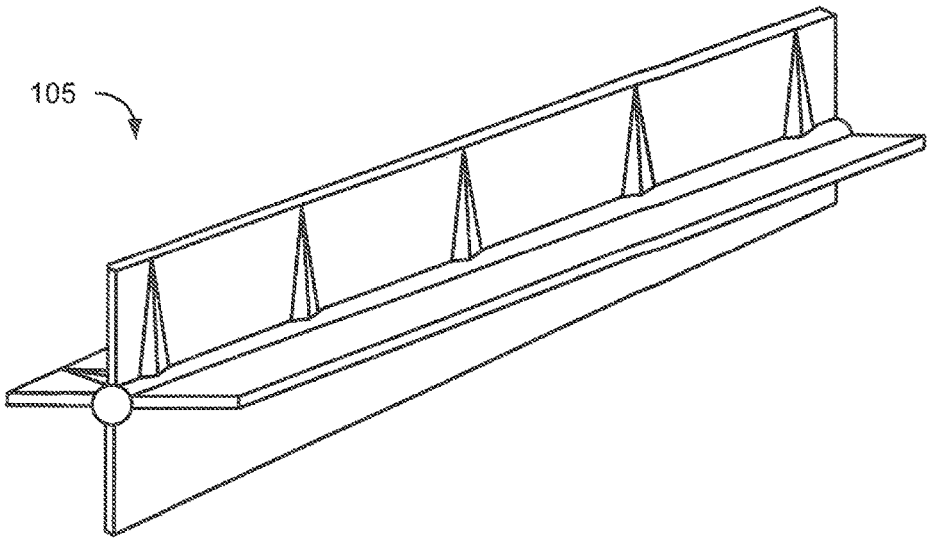

FIGS. 1A-1B illustrate perspective views of example separators 100, 105 that include longitudinally spaced radial ridges. The separator 100 of FIG. 1A includes longitudinally spaced sets of projections on which radial ridges are formed. The separator 105 of FIG. 1B includes longitudinally continuous projections on which radial ridges are formed. The separator 100 of FIG. 1A is described in greater detail below. With the exception of the longitudinally continuous projections, it will be appreciated that the separator 105 of FIG. 1B may include components that are similar to those of the separator 100 of FIG. 1A.

Turning now to FIG. 1A, the example separator 100 may include a central portion 110 and a plurality of sets of projections 115A-C may extend from the central portion 110 with each projection (generally referred to as projection 115) extending between an adjacent set of twisted pairs. As explained in greater detail below, the central portion 110 and the projections may be formed from a wide variety of suitable materials, may have a wide variety of suitable dimensions, and may be arranged in a wide variety of suitable configurations. Additionally, a plurality of longitudinally spaced radial ridges 120A-L may be formed on or otherwise incorporated into the projections. Each of the components of the separator 100 is described in greater detail below.

The central portion 110 (or spine 110) may be formed with a wide variety of suitable dimensions and/or constructions. For example, the spine 110 may be formed with any suitable cross-sectional shape. As shown in FIG. 1, the spine 110 may have a circular cross-sectional shape. In other embodiments, the spine 110 may be formed with an elliptical, rectangular, approximately rectangular (e.g., rectangular with tapering edges, rectangular with rounded corners, etc.) square, triangular, hexagonal, octagonal, or any other suitable cross-sectional shape. For example, the separator 100 may be extruded with the projections 115 extending from a central portion, and the spine 110 may have an approximately rectangular shape that corresponds to the shapes of the projections 115 and/or to the thickness of the projections 115. Additionally, the spine 110 may be formed with a wide variety of suitable cross-sectional areas, diameters, and/or other cross-sectional dimensions.

The spine 110 may also be formed with a wide variety of suitable lengths. In certain embodiments, the spine 110 may be formed from a single segment or portion that extends along a longitudinal length of a cable. In other embodiments, the spine 110 may be formed from a plurality of discrete segments or portions positioned adjacent to one another along a longitudinal length of a cable, such as a plurality of segments that are arranged end to end. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable. Regardless of whether a spine 110 is formed from one or a plurality of segments, as desired in various embodiments, one or more dimensions of the spine 110 may be varied along a longitudinal direction. For example, the spine 110 may include various portions with different diameters, cross-sectional shapes, and/or other dimensions. Dimensional variations may be arranged in accordance with any desirable pattern or, alternatively, in a random or pseudo-random manner.

The spine 110 may also be formed from a wide variety of suitable materials and/or combinations of materials including, but not limited to, dielectric materials (e.g., polymeric materials, etc.), conductive materials, semi-conductive materials, etc. For example, the spine 110 may be formed from paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, one or more semi-conductive materials (e.g., materials that incorporate carbon, etc.), one or more dielectric shielding materials (e.g., barium ferrite, etc.) or any other suitable material or combination of materials. In certain embodiments, the spine 110 may have a relatively flexible body. As desired, the spine 110 may be filled, unfilled, foamed, un-foamed, homogeneous, or inhomogeneous and may or may not include additives (e.g., flame retardant materials, smoke suppressant materials, strength members, water swellable materials, water blocking materials, etc.). In certain embodiments, the spine 110 may include one or more longitudinal channels or cavities. For example, one or more longitudinal channels may facilitate temperature normalization and/or cooling within the cable. As another example, one or more channels and/or cavities may be provided and other suitable cable components may be positioned with the channels and/or cavities including, but not limited to, transmission media (e.g., one or more optical fibers), flame retardant material, smoke suppressant material, etc. As desired, any number of secondary channels may extend between a longitudinal channel and an outer surface of the separator 100.

In certain embodiments, the spine 110 may be formed without incorporating shielding material. For example, the separator 110 may be formed from suitable dielectric materials. In other embodiments, electromagnetic shielding material may be incorporated into the spine 110. A wide variety of different types of materials may be utilized to provide shielding, such as electrically conductive material, semi-conductive material, and/or dielectric shielding material. A few examples of suitable materials are described in greater detail below with reference to the projections 115 and are equally applicable to the spine 110. In certain embodiments, shielding material may be formed on one or more surfaces of the spine 110. For example, shielding material may be formed on an external surface of the spine 110 and/or within one or more channels. In other embodiments, shielding material may be embedded within the body of the spine 110. In yet other embodiments, a spine 110 may be formed from one or more suitable shielding materials.

For a spine 110 formed from a plurality of discrete segments, the various portions or segments of the spine 110 may include a wide variety of different lengths and/or sizes. In certain embodiments, spine portions may have a common length. In other embodiments, portions of the spine 110 may have varying lengths. These varying lengths may follow an established pattern or, alternatively, may be incorporated into the cable at random. Additionally, in certain embodiments, each segment or portion of the spine 110 may be formed from similar materials. In other embodiments, a spine 110 may make use of alternating materials in adjacent portions (whether or not a gap is formed between adjacent portions). For example, a first portion or segment of the spine 110 may be formed from a first set of one or more materials, and a second portion or segment of the spine 110 may be formed from a second set of one or more materials. As one example, a relatively flexible material may be utilized in every other portion of a spine 110. As another example, relatively expensive flame retardant material may be selectively incorporated into desired portions of a spine 110. A wide variety of other material combinations may be utilized as desired.

With continued reference to FIG. 1A, a plurality of projections may extend from the spine 110. As shown, in certain embodiments, respective sets of one or more projections 115A, 115B, 115C may be longitudinally spaced along a longitudinal length of the spine 110. Additionally, a longitudinal gap or space may be present between each set of adjacent projections. For example, a first set of one or more projections 115A may extend from the spine 110 at a first location located along the longitudinal length of the separator 100. A second set of one or more projections 115B may then extend from the spine 110 at a second location along a longitudinal length of the separator 100. The second location may be situated adjacent to the first location along the longitudinal length of the separator 100. Even though a longitudinal gap is present between the first and second locations, no other sets of projections extend from the spine 110 between the first and second locations. A third set of one or more projections 115C may then extend from the spine 110 at a third location positioned on an opposite side of the second location with a suitable longitudinal gap or space between the second and third locations. Any other number of sets of projections may extend from the spine 110 along a longitudinal length of the separator 100 in a similar manner.

Any suitable gap or longitudinal space may be present between at least two adjacent longitudinally spaced locations. In other words, a longitudinal gap may be present along the separator 100 between adjacent locations at which projections extend. The longitudinal gap may correspond to the spacing in a longitudinal direction between the endpoint of a first set of one or more projections and the starting point of a second set of one or more projections longitudinally adjacent to the first set. A wide variety of suitable longitudinal gaps may be utilized as desired in various embodiments. In certain embodiments, a longitudinal gap of approximately 1, 2, 3, 4, 5, 6, 7, 8, 9, 10, 12, 14, 15, 16, 18, 20, 25, 30, 40, or 50 cm, a gap incorporated into a range between any two of the above values, or a gap incorporated into a range bounded on either a minimum or maximum end by one of the above values may be present between longitudinally adjacent locations at which projections extend. Other suitable longitudinal gaps may be utilized as desired. Additionally, in certain embodiments, various gaps positioned along a longitudinal length of the separator 100 may have longitudinal lengths or sizes that are approximately equal. In other embodiments, the longitudinal lengths of gaps may be varied in accordance with any desired pattern or, alternatively, in a random or pseudo-random manner. The longitudinal spaces between adjacent sets of projections may facilitate a reduction in material utilized to form the separator 100 and/or may enhance the flexibility of the separator 100 and a cable into which the separator 100 is incorporated.

In other embodiments, one or more projections may be formed to be relatively continuous along a longitudinal direction. FIG. 1B illustrates an example separator 105 having longitudinally continuous projections. In yet other embodiments, respective sets of one or more projections may be formed at a plurality of longitudinally spaced locations without longitudinal gaps or spaces between adjacent sets of one or more projections. However, the projections included in longitudinally adjacent sets may extend in different directions from the spine. For example, a first set of one or more projections may extend in a first set of respective directions. A second set of one or more projections longitudinally adjacent to the first set may extend in a second set of respective directions, and at least one direction of extension in the second set may be different than the direction(s) of extension included in the first set. In other embodiments, a separator may be formed with longitudinally spaced projections, and one or more directions of extension may be varied as desired for sets of projections.

Regardless of whether longitudinal gaps are positioned between various sets of longitudinally spaced projections, any suitable number of projections may extend from the spine at each longitudinally spaced location. In other words, the set of projections (e.g., 115A, 115B, 115C, etc.) positioned at each longitudinally spaced location may include any number of suitable projections, such as one, two, three, four, or more projections. As shown in FIG. 1A, four projections may respectively extend at guadrantile angles at each longitudinally spaced location. Accordingly, in a cable included four twisted pairs, respective projections may extend between each set of adjacent twisted pairs. In this regard, the projections may form or function as a cross-filler. Other suitable numbers of projections may be utilized for cables having more or less than four twisted pairs. In other embodiments, at a given location, one or more projections may extend between a portion of the sets of adjacent twisted pairs. For example, with a four twisted pair cable, one, two, or three projections may extend at a given location. In other words, projections will not extend between all of the adjacent sets of twisted pairs. The separator 100 may function as a cross-filler that includes projections or fins that provide separation between each adjacent set of twisted pairs along a longitudinal length; however, at any given location along the longitudinal length, projections may not extend between all of the twisted pairs.

In the event that the directions of extension of various sets of projections are varied along a longitudinal length of the separator 100, a wide variety of suitable configurations of projections may be utilized as desired. In certain embodiments, a single projection may extend from each longitudinally spaced location, and the projections may alternate directions of extension, for example, at approximately ninety degree (90°) angles or in accordance with any other suitable pattern. In other embodiments, two projections may extend from each longitudinally spaced location in opposite directions from the spine 110. The directions of extension may then alternate by approximately one hundred and eighty degrees (180°) between adjacent spaced locations. For example, projections may alternate between up/down and left/right orientations. In other embodiments, two projections may extend from each longitudinally spaced location with an approximately ninety degree (90°) angle between the two projections. The directions of extension for the two projections may then be varied between adjacent longitudinally spaced locations. For example, projections may alternate between left/up and right/down orientations. As another example, the directions of extension may be rotated by approximately ninety degrees (90°) at each longitudinally spaced location. Other suitable configurations of two projections may be utilized as desired. In yet other embodiments, three projections may extend from each longitudinally spaced location, and a projection that is not present may be alternated or otherwise varied along a longitudinal length. For example, a projection that is not present may be alternated at approximately ninety degree (90°) angles at adjacent longitudinally spaced locations.

Additionally, in certain embodiments, the same number of projections may extend from each of the longitudinally spaced locations. For example, as shown in FIG. 1A, four projections may extend from each longitudinally spaced location. In other examples, one, two, or three projections may extend from each longitudinally spaced location. As desired, the direction of extension of projections at various locations may be alternated or otherwise varied. In other embodiments, a different number of projections may extend from at least two of the longitudinally spaced locations. For example, four projections may extend from a first longitudinally spaced location while two projections extend from a second longitudinally spaced location. Other variations may be utilized as desired.

In certain embodiments, the separator 100 illustrated in FIG. 1A may function as a cross-filler. In other words, in a cable having four twisted pairs, one or more projections may extend between each adjacent set of twisted pairs. If viewed along a cross-section of a cable, the separator 100 may have one or more projections extending in each quadrantile direction. In other embodiments, a separator may be formed with any other suitable cross-sectional shape. For example, a separator may be formed with prongs that extend in opposite directions from a spine or central portion such that the separator bisects a core of a cable. Two sets of twisted pairs may be positioned on either side of the separator within a cable. A wide variety of other suitable cross-sectional shapes that include projections or prongs extending from a central portion may be formed as desired in other embodiments.

Each projection (generally referred to as projection 115), prong, fin, or extension may include any suitable projection or other component that radially extends from a spine 110. In certain embodiments, each projection 115 may extend between an adjacent set of twisted pairs, thereby providing separation between the twisted pairs that may enhance the electrical performance of a cable or cable component. A projection 115 may be formed with a wide variety of suitable dimensions, such as a wide variety of suitable cross-sectional shapes, cross-sectional areas, thicknesses, distances of projection (i.e., length of projection from the spine 110), and/or longitudinal lengths. In certain embodiments, each projection 115 may be formed with substantially similar dimensions (e.g., cross-sectional shape, thickness, distance of projection, longitudinal length, etc.). In other embodiments, at least two projections may be formed with different dimensions.

For purposes of this disclosure, the cross-sectional shape of a projection 115 may refer to the shape of a projection 115 along a longitudinal length of the separator 100. The projections illustrated in FIG. 1A may be formed with rectangular cross-sectional shapes. In various embodiments, a projection 115 may be formed with a rectangular, approximately rectangular, semi-circular, square, approximately square (e.g., square with rounded corners, etc.), parallelogram, trapezoidal, triangular, approximately triangular, spike, or any other suitable cross-sectional shape. Additionally, a projection 115 may be formed with a wide variety of suitable longitudinal lengths. A longitudinal length of a projection may be a length that a projection occupies along the longitudinal dimension of the separator 100. In certain embodiments, a projection 115 may have a longitudinal length of approximately 0.5, 1, 1.5, 2, 2.5, 3, 4, 5, 6, 7, 8, 9, 10, 15, 20, 25, 30, 35, 40, 45, 50, 55, 60, 65, 70, 75, 80, 85, or 90 cm, a length incorporated into a range between any two of the above values, or a length incorporated into a range bounded on either a minimum or maximum end by one of the above values. Other suitable longitudinal lengths may be utilized as desired. In certain embodiments, each projection 130 may have an approximately equal longitudinal length.

In other embodiments, at least two projections may have different longitudinal lengths.

A projection 115 may also be formed with a wide variety of suitable distances of projection. In other words, a projection 115 may extend or project any suitable distance from the spine 110 or a central point. In certain embodiments, a projection 115 may have a distance of extension that is less than or approximately equal to the diameter of a twisted pair (e.g., the combined diameters of the two conductors of a twisted pair). In other words, the projection 115 may not extend past the twisted pair within a cable core. For example, a projection 115 may have a distance of projection that is approximately 0.25, 0.3, 0.35, 0.4, 0.45, 0.5, 0.55, 0.6, 0.65, 0.7, 0.75, 0.8, 0.85, 0.9, or 1.0 times the diameter of a twisted pair, a distance of projection included in a range between any two of the above values, or a distance of projection included in a range bounded on either a minimum or maximum end by one of the above values. In other embodiments, a projection 115 may have a distance of projection that is approximately equal to a radius of a cable core. In other words, the projection 115 may extend approximately between the spine 110 and an adjacent wrap layer (e.g., a shield layer, a jacket, etc.). In other embodiments, a projection 115 may have a distance of projection that permits the projection 115 to extend beyond an outer periphery of the twisted pairs (e.g., the space occupied by the twisted pairs in a cable core). As desired, an extending portion of a projection 115 may be curled or wrapped around the outer periphery of the twisted pairs. In this regard, the projection 115 may provide separation between the twisted pairs and one or more other cable components, such as a shield layer or an outer jacket. Additionally, the distances of projection discussed above refer to a projection 115 that extends in a single direction from the spine 110. In certain embodiments, a projection 115 may be characterized as extending through the spine 110 and/or in multiple directions from the spine 110 (e.g., in both a north and south direction, in both an east and west direction, etc.). In these embodiments, a projection 115 may be formed with a length that accounts for both directions of extension and the cross-sectional area of the spine 110.

A projection 115 may also be formed with a wide variety of suitable thicknesses. For example, a projection 115 may have a thickness of approximately 0.003, 0.005, 0.007, 0.01, 0.015, 0.02, 0.025, 0.03, 0.04, 0.05, 0.06, 0.07, 0.08, 0.09, or 0.1 inches, a thickness included in a range between any two of the above values, or a thickness included in a range bounded on either a minimum or maximum end by one of the above values. In certain embodiments, a projection 115 may have a relatively uniform thickness. In other embodiments, the thickness of a projection 115 may vary. For example, in certain embodiments, one or more projections 115 may taper or narrow as they extend away from the spine 110. A wide variety of ratios between a base thickness and a tip thickness may be utilized as desired in various embodiments for a projection 115.

According to an aspect of the disclosure, radial ridges, ribs or extensions, may be incorporated into the separator 100 and formed on one or more projections. Each radial ridge (generally referred to as radial ridge 120) may extend from a surface of a projection 115, and therefore, increase an overall thickness and/or a separation distance provided by the projection 115. In other words, the projection 115 may provide a base separation distance between adjacent twisted pairs and, if the projection 115 is wrapped at least partially around an outer periphery of the twisted pairs, between the twisted pairs and an outer wrap. When a radial ridge 120 extends from a projection 115, the provided separation distance will be the sum of the base separation distance and the thickness of the radial ridge. The radial ridges will increase the separation distance provided by the separator 100. Additionally, because the radial ridges are longitudinally spaced, desired separation distances (e.g., distances between adjacent twisted pairs, a distance between twisted pairs and an outer wrap, etc.) may be provided by the separator 100 while reducing the overall material required for the separator 100 relative to conventional separators.

A projection 115 may be formed from a wide variety of suitable materials and/or combinations of materials including, but not limited to, dielectric materials (e.g., polymeric materials, etc.), conductive materials, semi-conductive materials, etc. For example, a projection 115 may be formed from paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, one or more metallic materials (e.g., silver, copper, nickel, steel, iron, annealed copper, gold, aluminum, etc.), one or more metallic alloys, one or more conductive composite materials, one or more semi-conductive materials (e.g., materials that incorporate carbon, etc.), one or more dielectric shielding materials (e.g., barium ferrite, etc.) or any other suitable material or combination of materials. Additionally, in various embodiments, a projection 115 may be formed with any number of suitable layers, such as one or a plurality of layers. As desired, a projection 115 may be foamed, unfoamed, homogeneous, or inhomogeneous and may or may not include additives (e.g., flame retardant materials, smoke suppressant materials, shielding materials, water swellable materials, water blocking materials, etc.).

In certain embodiments, each of the projections and/or sets of projections 11I 5A-C may be formed with similar dimensions and/or material constructions. In other embodiments, at least two projections may be formed with different dimensions (e.g., diameters, cross-sectional shapes, etc.) and/or material constructions. For example, different sets of projections may be formed with different longitudinal lengths. As another example, different sets of projections may be formed with different cross-sectional shapes. As yet another example, in certain embodiments, a first portion of the projections may be formed from dielectric materials while a second portion of the projections may be formed from or incorporate shielding material. As yet another example, a first portion of the projections may be formed from or incorporate flame retardant materials while a second portion of the projections may be formed from other materials. As desired, projections having different dimensions and/or material constructions may be arranged in accordance with any desirable pattern or, alternatively, in a random or pseudo-random manner.

According to an aspect of the disclosure, a plurality of longitudinally spaced radial ridges 120A-L may be incorporated into the separator 100. Each radial ridge (generally referred to as radial ridge 120) may be formed on a surface of a projection 115. The radial ridge 120 may extend away from the projection 115, for example, towards an adjacent twisted pair. In the event that a projection 115 extends beyond a plurality of twisted pairs and is wrapped around an outer periphery of the twisted pairs, the radial ridge 120 may extend towards an outer wrap, such as a cable jacket or shield layer. As a result of extending away from a projection 115, a radial ridge 120 may increase a separation distance between a projection 115 and a twisted pair and/or an outer wrap beyond a separation distance that would be provided by the projection alone. With the use of a plurality of longitudinally spaced radial ridges, desired separation distances may be maintained while reducing an amount of material required to form a separator 100 relative to conventional separators. Accordingly, an overall cost of the separator 100 may be reduced by using longitudinally spaced radial ridges.

A wide variety of suitable configurations of radial ridges 120A-H may be utilized as desired in various embodiments. In certain embodiments, as shown in FIG. 1A, a respective radial ridge may be formed on each projection. For example, a first set of respective radial ridges 120A-D may be formed on each of the four projections included in a first set of projections 115A. Similarly, a second set of respective radial ridges 120E-H may be formed on the projections included in a second set of projections 115B, and a third set of respective radial ridges 120I-L may be formed on the projections included in a third set of projections 115C. Other sets of projections may also include radial ridges formed on each projection. In other embodiments, a plurality of spaced radial ridges may be formed on one or more projections. For example, as shown in the separator 105 of FIG. 1B, a plurality of spaced radial ridges may respectively be formed on each longitudinally continuous projection. In other example embodiments, a plurality of spaced radial ridges may be formed on a projection that is not longitudinally continuous. In yet other embodiments, one or more radial ridges may be respectively formed on a portion or subset of the projections while another portion or subset of projections does not include any radial ridges.

In certain embodiments, radial ridges may be formed in a clockwise or counterclockwise manner around an outer periphery of the separator 100. For example, respective radial ridges may be formed on respective first surfaces of various projections while no radial ridges are formed on the opposite surfaces of the projections. With reference to the first set of projections 115A illustrated in FIG. 1A, respective radial ridges 120A-D may be formed on similar sides or surfaces of the projections as one works around an outer periphery of the separator 100. In this regard, a single radial ridge 120A-D within the set of projection 115A may extend towards each twisted pair. Such an arrangement of radial ridges may facilitate desired separation distances between the twisted pairs.

As desired in various embodiments, one or more radial ridges may be formed at each of a plurality of longitudinally spaced locations. As shown in FIG. 1A, in certain embodiments, corresponding radial ridges may be formed for each twisted pair at respective longitudinally spaced locations 115A-C. For example, four radial ridges may be included in each set of longitudinally spaced ridges. In other embodiments, radial ridges for various twisted pairs may be longitudinally spaced, staggered, or offset from one another along a longitudinal length of a separator. For example, each set of longitudinally spaced radial ridges may include less than four radial ridges. As discussed above, a separator may be formed with alternating projections or other projection configurations in which less than four projections are present at various longitudinally spaced locations. In these embodiments, radial ridges may be formed on a portion or all of the projections at longitudinally spaced locations such that each set of spaced radial ridges includes less than four ridges. In other embodiments, radial ridges may be selectively formed on projections such that each set of longitudinally spaced radial ridges includes less than four rides.

In the event that longitudinally spaced sets of radial ridges include less than four ridges (or another suitable number based upon a separator design and/or number of projections, etc.), a wide variety of suitable radial ridge configurations may be utilized. For example, in certain embodiments, a single radial ridge may be formed at each spaced location, and the ridges may be alternated between respective twisted pairs (e.g., alternated at approximately ninety degree (90°) angles, etc.). As another example, two radial ridges may be formed at each spaced location, and the ridges may be alternated between respective groupings of twisted pairs (e.g., alternated by approximately one hundred and eighty degrees (180°), etc.) As yet another example, three radial ridges may be formed at each spaced location, and an omitted radial ridge may be alternated between respective twisted pairs (e.g., alternated at approximately ninety degree (90°) angles, etc.).

Regardless of the number of radial ridges formed at each longitudinally spaced location and/or an arrangement of radial ridges, a wide variety of suitable longitudinal gaps may be utilized as desired between each spaced set of radial ridges. In certain embodiments, a longitudinal gap of approximately 0.25, 0.5, 1, 2, 3, 4, 5, 6, 7, 8, 9, 10, 12, 14, 15, 16, 18, 20, 25, 30, 40, or 50 cm, a gap incorporated into a range between any two of the above values, or a gap incorporated into a range bounded on either a minimum or maximum end by one of the above values may be present between longitudinally adjacent sets of radial ridges. Other suitable longitudinal gaps may be utilized as desired. Additionally, in certain embodiments, various gaps positioned along a longitudinal length of the separator 100 may have longitudinal lengths or sizes that are approximately equal. In other embodiments, the longitudinal lengths of gaps may be varied in accordance with any desired pattern or, alternatively, in a random or pseudo-random manner.

A radial ridge 120 may be formed with a wide variety of suitable dimensions, such as a wide variety of suitable cross-sectional shapes, cross-sectional areas, thicknesses, widths or longitudinal distances, and/or distances of radial extension (i.e., length of radial extension along a projection 115). In certain embodiments, each radial ridge 120 may be formed with substantially similar dimensions (e.g., cross-sectional shape, thickness, distance of radial projection, width or longitudinal length, etc.). In other embodiments, at least two radial ridge 120 may be formed with different dimensions.

For purposes of this disclosure, the cross-sectional shape of a radial ridge 120 may refer to the shape of a radial ridge 120 as it extends in a radial direction along a surface of a projection 115. The projections illustrated in FIG. 1A may be formed with triangular cross-sectional shapes. In various embodiments, a radial ridge 120 may be formed with a triangular, semi-circular, rectangular, approximately rectangular (e.g., rectangular with rounded corners, etc.), square, approximately square (e.g., square with rounded corners, etc.), trapezoidal, or any other suitable cross-sectional shape. A few example cross-sectional shapes are discussed in greater detail below with reference to FIGS. 5A-5D. Additionally, a radial ridge 120 may be formed with a wide variety of suitable widths or dimensions along a longitudinal length of a separator 100. In certain embodiments, a radial ridge 120 may have a width or longitudinal length of approximately 0.005, 0.01, 0.02, 0.03, 0.04, 0.05, 0.06, 0.08, 0.1, 0.125, 0.15, 0.2, 0.4, 0.5, 0.6, 0.8, 1, 2, 2.5, 3, 4, 5, 6, 7, 8, 9, or 10 cm, a width incorporated into a range between any two of the above values (e.g., a width between approximately 0.005 cm and approximately 10 cm), or a with incorporated into a range bounded on either a minimum or maximum end by one of the above values. Other suitable widths may be utilized as desired. In certain embodiments, each radial ridge 120 may have an approximately equal longitudinal length.

A radial ridge 120 may also be formed with a wide variety of suitable distances of radial projection or extension along a projection 115. In certain embodiments, a radial ridge 120 may extend along an entire distance of radial projection of a given projection 115 as it extends away from the spine 110. In other words, a radial ridge 120 may extend approximately from the spine 110 to a distal end of a projection 115. In other embodiments, a radial ridge 120 may extend along a portion of a distance of radial projection of a projection 115 on which the radial ridge 120 is formed. For example, a radial ridge 120 may extend approximately from the spine 110 partially across a projection 115 such that the radial ridge 120 provides for a desired separation distance between an adjacent set of twisted pairs. As another example, a radial ridge 120 may extend from a distal end of a projection 115 partially across the projection 115 towards the spine 110. In certain embodiments, a radial ridge 120 formed at or near a distal end or tip of a projection 115 may provide desired separation between twisted pairs and an outer wrap (e.g., a jacket etc.) when the projection is wrapped around an outer periphery of the twisted pairs.

Additionally, in certain embodiments, a radial ridge 120 may be formed with a single section that extends away from a surface of a projection 115. In other embodiments, a radial ridge 120 may include a plurality of sections or portions that extend away from a surface of a projection 115. Characterized in another manner, at a given longitudinal location, it may appear as if a plurality of radial ridges are formed on a surface of a projection 115. A wide variety of various radial ridge configuration may be formed that include a plurality of sections or portions. For example, respective ridge portions may be formed at or near a base and a distal end or tip of a projection. A few example radial ridge configurations that include one or a plurality of sections are described in greater detail below with reference to FIGS. 4A-4G.

In the event that a radial ridge 120 or a section of a radial ridge 120 extends partially across a surface of a projection 115 in a radial direction, the ridge 120 or ridge section may have any suitable distance of radial extension as desired in various embodiments. In certain embodiments, a radial ridge 120 or ridge section may have a distance of radial extension that is approximately 0.1, 0.15, 0.2, 0.25, 0.3, 0.35, 0.4, 0.45, 0.5, 0.55, 0.6, 0.65, 0.7, 0.75, 0.8, 0.85, 0.9, or 0.95 times a distance of radial projection or extension of a projection 115, a distance of included in a range between any two of the above values, or a distance included in a range bounded on either a minimum or maximum end by one of the above values.

A radial ridge 120 (or radial ridge section) may also be formed with a wide variety of suitable thicknesses or distances of extension from a surface of a projection 115, such as a thickness of approximately 0.20 inches. In other example embodiments, a radial ridge 120 (or radial ridge section) may have a thickness of approximately 0.005, 0.01, 0.015, 0.02, 0.025, 0.04, 0.05, 0.06, 0.08, 0.1, 0.15 0.2, 0.25, or 0.3 inches, a thickness included in a range between any two of the above values, or a thickness included in a range bounded on either a minimum or maximum end by one of the above values. In certain embodiments, a radial ridge 120 (or radial ridge section) may have a relatively uniform thickness. In other embodiments, the thickness of a radial ridge (or radial ridge section) 120 may vary. For example, in certain embodiments, a radial ridge 120 may taper or narrow as it extends along a radial direction. A wide variety of ratios of tapering between a first thickness at a first point and second thickness at a second point of a radial ridge may be utilized as desired in various embodiments. For example, a ratio of a thickness to a second thickness may be approximately 2:1, 3:1, 4:1, 5:1, 6:1, 7:1, 8:1, 9:1, 10:1, 12:1, 15:1, 17:1, 20:1, 22:1, 25:1, a ratio included in a range between any two of the above values, or any other suitable ratio.

A radial ridge 120 may be formed from a wide variety of suitable materials and/or combinations of materials including, but not limited to, dielectric materials (e.g., polymeric materials, etc.), conductive materials, semi-conductive materials, etc. For example, a radial ridge 120 may be formed from paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA. PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, one or more metallic materials (e.g., silver, copper, nickel, steel, iron, annealed copper, gold, aluminum, etc.), one or more metallic alloys, one or more conductive composite materials, one or more semi-conductive materials (e.g., materials that incorporate carbon, etc.), one or more dielectric shielding materials (e.g., barium ferrite, etc.) or any other suitable material or combination of materials. Additionally, in various embodiments, a radial ridge 120 may be formed with any number of suitable layers, such as one or a plurality of layers. As desired, a radial ridge 120 may be foamed, un-foamed, homogeneous, or inhomogeneous and may or may not include additives (e.g., flame retardant materials, smoke suppressant materials, shielding materials, water swellable materials, water blocking materials, etc.).

In certain embodiments, a radial ridge 120 may be formed in conjunction with the formation of a projection 115 and/or other components of a separator 100. For example, a separator 100 may be extruded to include projections having radial ridges. As such, a radial ridge 120 may be formed from the same or similar materials as a projection 115 and/or other components of a separator 100. In other embodiments, a radial ridge 120 may be formed, affixed to, or otherwise provided on an existing or preformed projection 115. As desired, the radial ridge 120 may be formed from the same material(s) and/or from different materials than the underlying projection 115. For example, a projection 115 may be formed from shielding material while a radial ridge 120 is formed from dielectric material. As another example, a projection 115 may be formed from flame retardant material while the radial ridge 120 is formed from other material (e.g., shielding material, dielectric material, etc.). Indeed, a wide variety of material combinations may be utilized in conjunction with various components of a separator 100.

Additionally, in certain embodiments, each of the radial ridges 120A-L incorporated into a separator 100 may be formed with similar dimensions and/or material constructions. In other embodiments, at least two radial ridges may be formed with different dimensions (e.g., cross-sectional shapes, distances of radial extension, widths, thicknesses, degrees of tapering, numbers of sections, etc.) and/or material constructions. As desired, radial ridges having different dimensions and/or material constructions may be arranged in accordance with any desirable pattern or, alternatively, in a random or pseudo-random manner.

A wide variety of suitable methods and/or techniques may be utilized to form a separator 100 as desired in various embodiments. In certain embodiments, the separator 100 may be extruded, molded, or otherwise formed with a predetermined shape. For example, a separator 100 may be extruded or otherwise formed to include both a spine 110, a plurality of projections 115A-C, and/or longitudinally spaced radial ridges 120A-L. In other embodiments, various components of a separator 100 may be separately formed, and then the components of the separator 100 may be joined or otherwise attached together via adhesive, bonding, or physical attachment elements (e.g., male and female connectors, pins, etc.). Regardless of the construction or materials utilized, in certain embodiments, the separator 100 may be formed with a predetermined configuration of projections 115A-C. In other words, the projections may be arranged in a desired orientation (e.g., directions of extension, etc.) when the separator 100 is formed. In other embodiments, a separator 100 may be formed with projections in a first configuration, and then the spine 110 of the separator 100 may be longitudinally twisted or otherwise manipulated in order to reorient the projections and radial ridges formed thereon into a desired configuration. A wide variety of suitable methods and/or techniques may be utilized to twist the separator 100 as desired in various embodiments. In certain embodiments, the separator 100 may be fed from one or more suitable sources (e.g., reels, spools, etc.) and connected downstream to one or more suitable twisting devices and/or machines that impart a twist on the separator 100 while back tension is supplied by the source(s) and/or any number of intermediary devices. The separator 100 may be twisted in a suitable direction, such as a clockwise or a counter-clockwise direction, as desired in various embodiments. Additionally, the separator 100 may be longitudinally twisted with any desired twist rate and/or twist lay. In certain embodiments, the twist rate and/or twist lay may be based at least in part upon the number of projections extending from the spine 110 at various cross-sectional locations. In other words, the twist rate and/or lay may be determined such that various projections extend from the spine 110 in desired directions or at desired angles.

As set forth above, in certain embodiments, a separator 100 may include or incorporate electromagnetic shielding material. Accordingly, the separator 100 may provide shielding for one or more of the twisted pairs 105A-D. For example, a shielding layer may be incorporated into the spine 110 (e.g., on one or more surfaces of the spine 110, sandwiched between two other layers of the spine 110, etc.), into any number of the projections 115A-C (e.g., on one or more surfaces of a projection 115, sandwiched between two other layers of a projection 115, etc.), and/or into any number of the radial ridges 120A-L. As another example, one or more components of the separator 100 (e.g., the spine 110, one or more projections 115A-C, one or more radial ridges 120A-L, etc.) may be formed from shielding material(s). As yet another example, shielding material may be embedded into one or more components of the separator 100. A wide variety of different types of materials may be utilized to provide shielding, such as electrically conductive material, semi-conductive material, and/or dielectric shielding material. A few examples of suitable materials are described in greater detail below with respect to the shielding layer illustrated in FIG. 2 and are equally applicable to shielding material incorporated into a separator 100. Additionally, in certain embodiments, the separator 100 may include shielding material and/or one or more shielding layers that are continuous along the longitudinal length of the separator 100. In other embodiments, the separator 100 may include discontinuous or discrete sections or portions of shielding material. As desired, patches of shielding material may be formed in accordance with a wide variety of suitable configurations and/or dimensions, such as any of the configurations and/or dimensions discussed with reference to the shield layer illustrated in FIG. 2.

FIG. 1B is a perspective view of another example separator 105 that includes longitudinally spaced radial ridges. As set forth above, the separator 105 may include projections that are relatively continuous along a longitudinal length. Additionally, a plurality of spaced radial ridges may be formed on each of the projections. Components of the separator 105 may be similar to those discussed above for the separator 100 of FIG. 1A. A wide variety of other suitable separator designs may be utilized as desired in various embodiments. These separators may include more or less components than the separators 100, 105 illustrated in FIGS. 1A and 1B, which are provided by way of non-limiting example.

Figure 2:
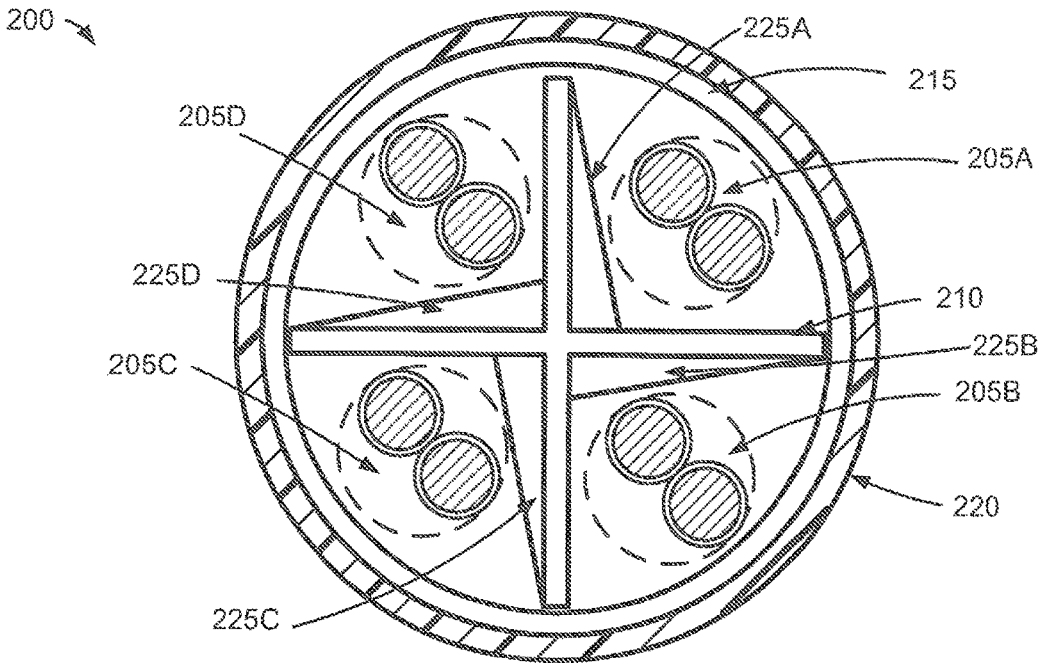
FIGS. 2 and 3 are cross-sectional views of example twisted pair cables that incorporate separators having longitudinally spaced radial ridges, according to illustrative embodiments of the disclosure.
Figure 3:
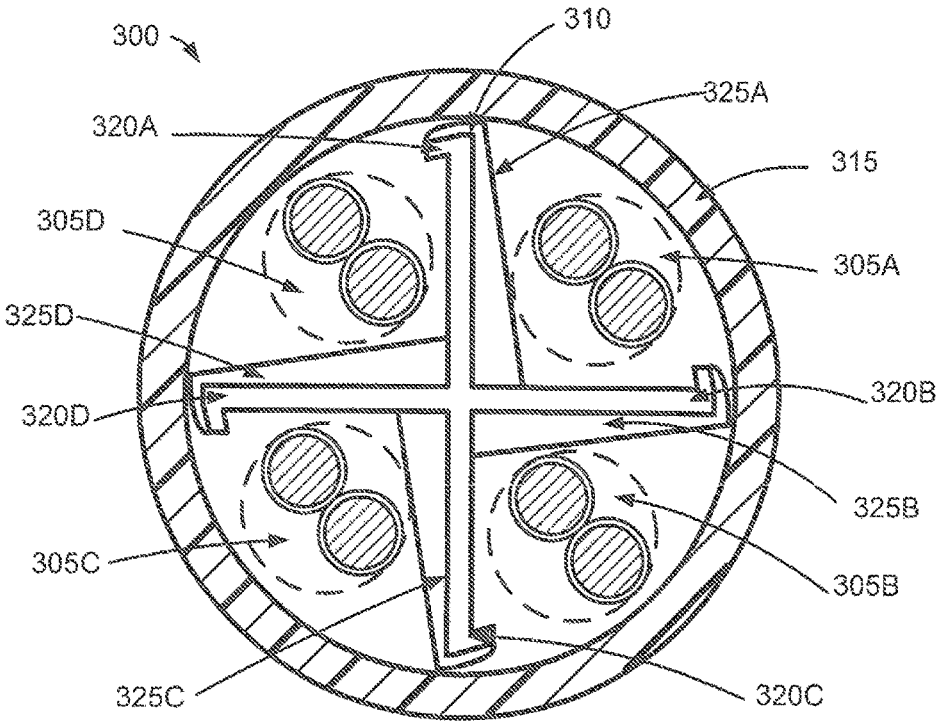

As desired, a separator including longitudinally spaced radial ridges, such as any of the example separators described herein, may be incorporated into a cable. For example, a separator may be positioned between a plurality of twisted pairs in a cable or a component of a cable. FIGS. 2 and 3 are cross-sectional views of example twisted pair cables 200, 300 that incorporate separators having longitudinally spaced radial ridges, according to illustrative embodiments of the disclosure. Turning first to FIG. 2, a cross-sectional view of a first example twisted pair cable 200 is illustrated. The cable 200 may include a plurality of twisted pairs 205A-D, a separator 210 positioned between the plurality of twisted pairs 205A-D, one or more optional shield layers (e.g., individual shields respectively formed around each of the twisted pairs, an overall shield 215 formed around the plurality of twisted pairs 205A-D and the separator 210, etc.), and a jacket 220 formed around the plurality of twisted pairs 205A-D and the separator 210. The cable 200) is illustrated as a twisted pair communications cable; however, other types of cables may be utilized, such as composite or hybrid cables including a combination of twisted pairs and other transmission media (e.g., optical fibers, etc.). Indeed, suitable cables may include any number of transmission media including, but not limited to, one or more twisted pairs, optical fibers, coaxial cables, and/or power conductors. Additionally, embodiments of the disclosure may be utilized in association with horizontal cables, vertical cables, flexible cables, equipment cords, cross-connect cords, plenum cables, riser cables, or any other appropriate cables. Each of the example components of the cable 200 are described below.

Although four twisted pairs 205A, 205B, 205C, 205D are illustrated in FIG. 2, any other suitable number of pairs may be utilized. As desired, the twisted pairs 205A-D may be twisted or bundled together and/or suitable bindings may be wrapped around the twisted pairs 205A-D. In other embodiments, multiple grouping of twisted pairs may be incorporated into a cable, and any of the groupings may include a respective separator. Additionally, as desired, the multiple groupings may be twisted, bundled, or bound together.

Each twisted pair (referred to generally as twisted pair 205) may include two electrical conductors, each covered with suitable insulation. Each twisted pair 205 can carry data or some other form of information at any desirable frequency, such as a frequency that permits the overall cable 200 to carry data at approximately 600 MHz or greater. As desired, each of the twisted pairs may have the same twist lay length or alternatively, at least two of the twisted pairs may include a different twist lay length. For example, each twisted pair may have a different twist rate. The different twist lay lengths may function to reduce crosstalk between the twisted pairs. A wide variety of suitable twist lay length configurations may be utilized. In certain embodiments, the differences between twist rates of twisted pairs that are circumferentially adjacent one another (for example the twisted pair 205A and the twisted pair 2051B) may be greater than the differences between twist rates of twisted pairs that are diagonal from one another (for example the twisted pair 205A and the twisted pair 205C). As a result of having similar twist rates, the twisted pairs that are diagonally disposed can be more susceptible to crosstalk issues than the twisted pairs 205 that are circumferentially adjacent, however, the distance between the diagonally disposed pairs may limit the crosstalk.

Additionally, in certain embodiments, each of the twisted pairs 205A-D may be twisted in the same direction (e.g., clockwise, counter clockwise). In other embodiments, at least two of the twisted pairs 205A-D may be twisted in opposite directions. Further, as desired in various embodiments, one or more of the twisted pairs 205A-D may be twisted in the same direction as an overall bunch lay of the combined twisted pairs. For example, the conductors of each of the twisted pairs 205A-D may be twisted together in a given direction. The plurality of twisted pairs 205A-D may then be twisted together in the same direction as each of the individual pair's conductors. In other embodiments, at least one of the twisted pairs 205A-D may have a pair twist direction that is opposite that of the overall bunch lay. For example, all of the twisted pairs 205A-D may have pair twist directions that are opposite that of the overall bunch lay.

The electrical conductors of a twisted pair 205 may be formed from any suitable electrically conductive material, such as copper, aluminum, silver, annealed copper, copper clad aluminum, gold, a conductive alloy, etc. Additionally, the electrical conductors may have any suitable diameter, gauge, cross-sectional shape (e.g., approximately circular, etc.) and/or other dimensions. Further, each of the electrical conductors may be formed as either a solid conductor or as a conductor that includes a plurality of conductive strands that are twisted together.

The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA. PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 205A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair 205 may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

The jacket 220 may enclose the internal components of the cable 200, seal the cable 200 from the environment, and provide strength and structural support. The jacket 220 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 220 may be formed as a single layer or, alternatively, as multiple layers. In certain embodiments, the jacket 220 may be formed from one or more layers of foamed material. As desired, the jacket 220 can include flame retardant and/or smoke suppressant materials. Additionally, the jacket 220 may include a wide variety of suitable shapes and/or dimensions. For example, the jacket 220 may be formed to result in a round cable or a cable having an approximately circular cross-section; however, the jacket 220 and internal components may be formed to result in other desired shapes, such as an elliptical, oval, or rectangular shape. The jacket 220 may also have a wide variety of dimensions, such as any suitable or desirable outer diameter and/or any suitable or desirable wall thickness. In various embodiments, the jacket 220 can be characterized as an outer jacket, an outer sheath, a casing, a circumferential cover, or a shell.

An opening enclosed by the jacket 220 may be referred to as a cable core, and the twisted pairs 205A-D, the separator 210, and other cable components (e.g., one or more shield layers, etc.) may be disposed within the cable core. Although a single cable core is illustrated in FIG. 2, a cable 200 may be formed to include multiple cable cores. In certain embodiments, a cable core may be filled with a gas such as air (as illustrated) or alternatively a gel, solid, powder, moisture absorbing material, water-swellable substance, dry filling compound, or foam material, for example in interstitial spaces between the twisted pairs 205A-D. In addition to the separator 210 and any shield layers, other elements can be added to the cable core as desired, for example one or more optical fibers, additional electrical conductors, additional twisted pairs, water absorbing materials, and/or strength members, depending upon application goals.

In certain embodiments, one or more shield layers may be incorporated into the cable 200. For example, as shown in FIG. 2, an overall shield 215 or an external shield may be disposed between the jacket 220 and the twisted pairs 205A-D. In other words, the overall shield 215 may be wrapped around and/or encompass the collective group of twisted pairs 205A-D and the separator 210. As shown, the overall shield 215 may be positioned between the twisted pairs 205A-D and the outer jacket 220. In other embodiments, the overall shield 215 may be embedded into the outer jacket 220, incorporated into the outer jacket 220, or even positioned outside of the outer jacket 220. In other example embodiments, individual shields may be provided for each of the twisted pairs 205A-D. As desired, multiple shield layers may be provided, for example, individual shields and an overall shield. Each utilized shield layer may incorporate suitable shielding material, such as electrically conductive material, semi-conductive material, and/or dielectric shielding material in order to provide electrical shielding for one or more cable components. Further, in certain embodiments, the cable 220 may include a separate armor layer (e.g., a corrugated armor, etc.) for providing mechanical protection.

Various embodiments of the overall shield 215 illustrated in FIG. 2 are generally described herein; however, it will be appreciated that other shield layers (e.g., individual shield layers, etc.) may have similar constructions. In certain embodiments, a shield 215 may be formed from a single segment or portion that extends along a longitudinal length of the cable 200. In other embodiments, a shield 215 may be formed from a plurality of discrete segments or portions positioned adjacent to one another along a longitudinal length of the cable 200. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable.

As desired, a shield 215 (or a shield segment) may be formed with a wide variety of suitable constructions and/or utilizing a wide variety of suitable techniques. In certain embodiments, a foil shield or braided shield may be utilized. In other embodiments, a shield 215 may be formed from a combination of dielectric material and shielding material. For example, a shield may be formed from a suitable tape structure that includes one or more dielectric layers and one or more layers of shielding material. As desired, a shield 215 may be formed as a relatively continuous shield (e.g., a shield with a relatively continuous layer of electrically conductive material, shielding material, etc.) or as a discontinuous shield having a plurality of isolated patches of shielding material. For a discontinuous shield, a plurality of patches of shielding material may be incorporated into the shield 215, and gaps or spaces may be present between adjacent patches in a longitudinal direction. A wide variety of different patch patterns may be formed as desired in various embodiments, and a patch pattern may include a period or definite step. In other embodiments, patches may be formed in a random or pseudo-random manner. Additionally, individual patches may be separated from one another so that each patch is electrically isolated from the other patches. That is, the respective physical separations between the patches may impede the flow of electricity between adjacent patches. In certain embodiments, the physical separation of other patches may be formed by gaps or spaces, such as gaps of dielectric material or air gaps.

A shield 215 may be formed from a wide variety of suitable materials and/or combinations of materials. For example, a shield 215 may include any number of suitable dielectric and/or shielding materials. A wide variety of suitable dielectric materials may be utilized to form one or more dielectric layers or portions of a shield 215 including, but not limited to, paper, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, polytetrafluoroethylene, ethylene tetrafluoroethylene ("ETFE"), ethylene chlorotrifluoroethylene ("ECTFE"), etc.), one or more polyesters, polyimide, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, one or more foamed materials may be utilized. Indeed, a dielectric layer may be filled, unfilled, foamed, un-foamed, homogeneous, or inhomogeneous and may or may not include one or more additives (e.g., flame retardant and/or smoke suppressant materials). Additionally, a dielectric layer may be formed with a wide variety of suitable thicknesses.

Additionally, each shielding layer or shielding portion of a shield 215 may be formed from a wide variety of suitable shielding materials and/or with a wide variety of suitable dimensions. As set forth above, a shielding layer may be formed as a relatively continuous layer or as a discontinuous layer having a plurality of isolated patches of shielding material. In certain embodiments, one or more electrically conductive materials may be utilized as shielding material including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

Additionally, a shielding layer and/or associated shielding material may be incorporated into a shield 215 utilizing a wide variety of suitable techniques and/or configurations. For example, shielding material may be formed on a base layer or a dielectric layer. In certain embodiments, a separate base dielectric layer and shielding layer may be bonded, adhered, or otherwise joined (e.g., glued, etc.) together to form a shield 215. In other embodiments, shielding material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the shielding material can be over-coated with a dielectric layer or electrically insulating film, such as a polyester coating. In other embodiments, shielding material may be embedded into a base layer or dielectric layer. In yet other embodiments, a shield 215 may be formed (e.g., extruded, etc.) from a shielding material.

The components of a shield 215 (or segment of a shield) may include a wide variety of suitable dimensions, for example, any suitable lengths in the longitudinal direction, widths (i.e., a distance of the shield that will be wrapped around one or more twisted pairs 205A-D) and/or any suitable thicknesses. For example, shielding material may have any desired thickness, such as a thickness of about 0.5 mils (about 13 microns), 2.0 mils, 2.5 mils, or greater. Additionally, a wide variety of segment and/or patch lengths (e.g., lengths along a longitudinal direction of the cable 200) of shielding material may be utilized. As desired, the dimensions of the segments and/or patches can be selected to provide electromagnetic shielding over a specific band of electromagnetic frequencies or above or below a designated frequency threshold. In certain embodiments, each patch of shielding material may have a length of about 0.05, 0.1, 0.2, 0.25, 0.3, 0.4, 0.5, 0.6, 0.7, 0.75, 0.8, 0.9, 1.0, 1.5, 2.0, 2.5, 3.0, 3.5, 4.0, 4.5, or 5.0 meters, a length included in a range between any two of the above values, or a length included in a range bounded on either a minimum or maximum end by one of the above values. Additionally, a wide variety of suitable gap distances or isolation gaps may be provided between adjacent patches. For example, the isolation spaces can have a length of about 0.5, 1.0, 1.5, 2.0, 2.5, 3.0, 3.5, 4, 5, 6, 7, 8, 9, or 10 mm, a length included in a range between any two of the above values, or a length included in a range bounded on either a minimum or maximum end by one of the above values.

In certain embodiments, a shielding layer may include shielding material or patches of shielding material that extend substantially across a width dimension of an underlying dielectric layer. In other embodiments, shielding material may be formed with a width that is different than the width of an underlying base layer or portion of the base layer. In yet other embodiments, a plurality of discontinuous patches of shielding material may be formed across or within a widthwise dimension, and widthwise gaps may be present between each of the plurality of patches. Indeed, any section or patch of shielding material may have any suitable width and a wide variety of different configurations of shielding material may be formed in a widthwise dimension. Additionally, patches of shielding material may have a wide variety of different shapes and/or orientations. For example, the patches may have a rectangular, trapezoidal, approximately triangular, or parallelogram shape. In certain embodiments, patches may be formed to be approximately perpendicular (e.g., square or rectangular segments and/or patches) to the longitudinal axis of twisted pairs 205A-D incorporated into a cable. In other embodiments, the patches may have a spiral direction that is opposite to or in the same direction as the twist direction of one or more pairs.

With continued reference to FIG. 2, a separator 210 or filler may be incorporated into the cable 200 and positioned between two or more of the twisted pairs 205A-D. In certain embodiments, the separator 210 may be configured to orient and/or position one or more of the twisted pairs 205A-D. The orientation of the twisted pairs 205A-D relative to one another may provide beneficial signal performance. According to an aspect of the disclosure, the separator 210 may include a plurality of longitudinally spaced radial ridges. For example, one or more respective radial ridges may be positioned at each of a plurality of longitudinally spaced locations along a length of the separator 210. A wide variety of suitable separators may be incorporated into the cable 200 as desired in various embodiments. In certain embodiments, any of the example separators illustrated in FIGS. 1A-11B and/or FIGS. 4A-4G may be incorporated into the cable 200.

As shown in FIG. 2, the separator 210 may include one or more respective projections that extend between each set of adjacent twisted pairs. However, the projections may not extend from a spine beyond an outer periphery occupied by the twisted pairs 205A-D. In other words, the projections may not project beyond the twisted pairs 205A-D such that a portion of one or more projections may be wrapped around the outer periphery of the twisted pairs 205A-D. Additionally, the separator 210 may include longitudinally spaced radially ridges. As shown, one or more respective radial ridges may be formed on each projection of the separator 210. At the illustrated cross-sectional point, a first radial ridge 225A is formed on a surface of a first projection, a second radial ridge 225B is formed on a surface of a second projection, a third radial ridge 225C is formed on a surface of a third projection, and a fourth radial ridge 225D is formed on a surface of a fourth projection. Additionally, the radial ridges 225A-D may be formed on similar surfaces of respective projections around a periphery of the separator 210. For example, the radial ridges 225A-D may be formed on similar projection surfaces in a clockwise configuration.

As set forth in greater detail above with reference to FIG. 1A, each of the radial ridges 225A-D may be formed with a wide variety of suitable dimensions. For example, each radial ridge (generally referred to as radial ridge 225) may be formed with a wide variety of suitable cross-sectional shapes, widths or lengths along a longitudinal direction, distances of radial extension along a surface of a projection, and/or thicknesses. As shown, each radial ridge 225 extends approximately across an entire radial distance of extension of a corresponding projection. Additionally, each radial ridge 225 has a thickness that tapers as the radial ridge 225 extends away from a central point or spine. In certain embodiments, a thicker base portion (i.e., a portion proximate to the base of a projection) of a radial ridge may provide desired separation distance between adjacent sets of twisted pairs while the tapering radial ridge allows an amount of material incorporated into the separator 210 to be limited or reduced relative to conventional separators. Accordingly, use of one or more tapered radial ridges 225A-D may facilitate a reduction in materials and/or cost of a separator 210. Although the radial ridges 225A-D of FIG. 1A are illustrated as tapered ridges, a wide variety of other suitable radial ridges with other dimensions may be utilized, such as any of the radial ridges described below with reference to FIGS. 4A-4G.

FIG. 3 illustrates a cross-sectional view of another example twisted pair cable 300 that may include a separator with longitudinally spaced radial ridges. Similar to the cable 200 of FIG. 2, the cable 300 may include a plurality of twisted pairs 305A-D, a separator 310 positioned between the plurality of twisted pairs 305A-D, and a jacket 320 formed around the plurality of twisted pairs 305A-D and the separator 310. As desired, one or more shield layers (e.g., individual shield layers, an overall shield, etc.) may also be incorporated into the cable 300. Each of the cable components may be similar to the corresponding components described above with reference to FIG. 2; however, the separator 310 is illustrated as having one or more projections 320A-D or prongs that extend beyond an outer periphery of the twisted pairs 305A-D. An extending portion of at least one of the projections 320A-D may be wrapped or curled around the outer periphery of the twisted pairs 305A-D. As a result, the at least one extending projection may provide separation between the twisted pairs 305A-D and an outer wrap (e.g., the jacket 315, etc.).

Additionally, one or more radial ridges 325A-D may be respectively formed on each of the projections 320A-D. At least one of the radial ridges 325A-D may extend from a projection in an extending portion of the projection that is wrapped around the twisted pairs 305A-D. As a result, at least one of the radial ridges 325A-D may provide enhanced or increased separation between the twisted pairs 305A-D and an outer wrap. Such separation may assist in reducing alien crosstalk within the cable 300. With continued reference to FIG. 3, each of the radial ridges 325A-D is illustrated as a tapered radial ridge. However, a wide variety of other suitable radial ridges with other dimensions may be utilized, such as any of the radial ridges described below with reference to FIGS. 4A-4G.

As desired in various embodiments, a wide variety of other materials may be incorporated into a cable, such as either of the cables 200, 300 illustrated in FIGS. 2 and 3. For example, as set forth above, a cable may include any number of conductors, twisted pairs, optical fibers, and/or other transmission media. As another example, one or more respective dielectric films or other suitable components may be positioned between the individual conductors of one or more of the twisted pairs. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), flame retardants, flame suppressants or extinguishants, gels, and/or other materials. The cables 200, 300 illustrated in FIGS. 2 and 3 are provided by way of example only. Embodiments of the disclosure contemplate a wide variety of other cables and cable constructions. These other cables may include more or less components than the cables 200, 300 illustrated in FIGS. 2 and 3. Additionally, certain components may have different dimensions and/or materials than the components illustrated in FIGS. 2 and 3. Further, although FIGS. 2 and 3 illustrate jacketed cables, the example separators discussed herein may also be utilized in any number of unjacketed cable components, such as unjacketed cable components that are incorporated into larger cables.

A wide variety of suitable separators including longitudinally spaced radial ridges may be utilized as desired in various embodiments of the disclosure. A few example separators 100, 105 are discussed above with reference to FIGS. 1A and B. FIGS. 4A-4G illustrate cross-sectional views of other example separators that may be utilized in accordance with various embodiments of the disclosure. Each of the example separators of FIGS. 4A-4G is illustrated as cross-filler (e.g., a cross-shaped cross-sectional shape); however, it will be appreciated that other suitable cross-sectional shapes may be utilized as desired in other embodiments.

Figure 4A:
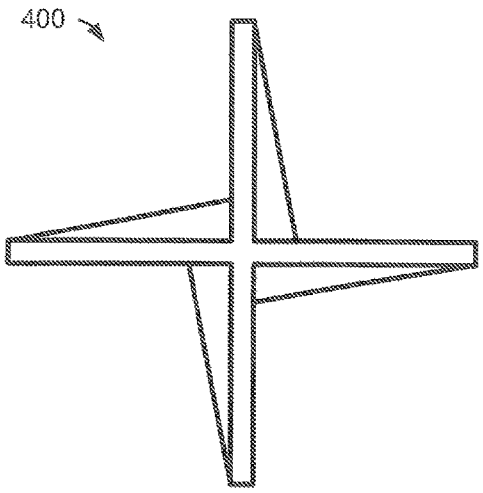
FIGS. 4A-4G are cross-sectional views of example separators that include longitudinally spaced radial ridges, according to illustrative embodiments of the disclosure.
Figure 4B:
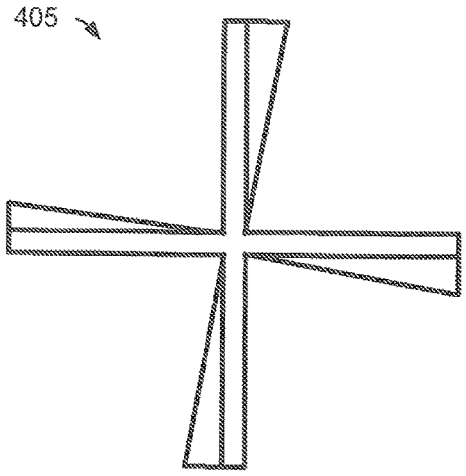
Figure 4C:
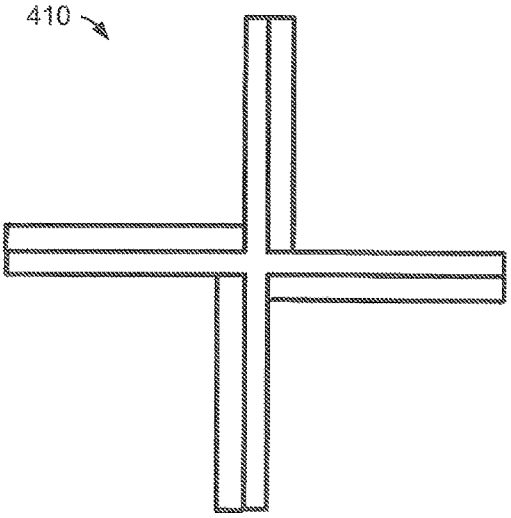
Figure 4D:
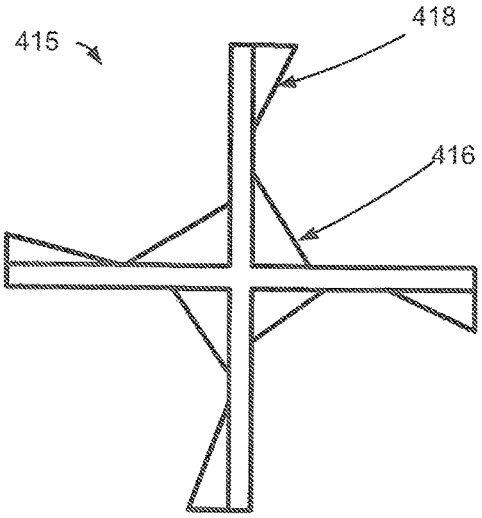

Turning first to FIG. 4A, a first example separator 400 is illustrated. The separator 400 may include prongs that extend from a central portion or spine in order to form a cross-filler in which at least one projection will be positioned between each set of adjacent twisted pairs of a cable. Additionally, longitudinally spaced radial ridges may be formed on the projections. For example, one or more radial ridges may be formed on each projection. As shown, each of the radial ridges may be formed as a tapered radial ridge having a thickness that narrows as the radial ridge extends away from a spine of the separator 400. By contrast, FIG. 4B illustrates another example separator 405 in which radial ridges may be formed as tapered radial ridges having thicknesses that narrow as the ridges extend towards a spine of the separator 405. FIG. 4D illustrates an example separator 410 in which radial ridges may be formed with relatively consistent thicknesses. In other words, the radial ridges may not taper or otherwise vary in thickness.

Figure 4E:
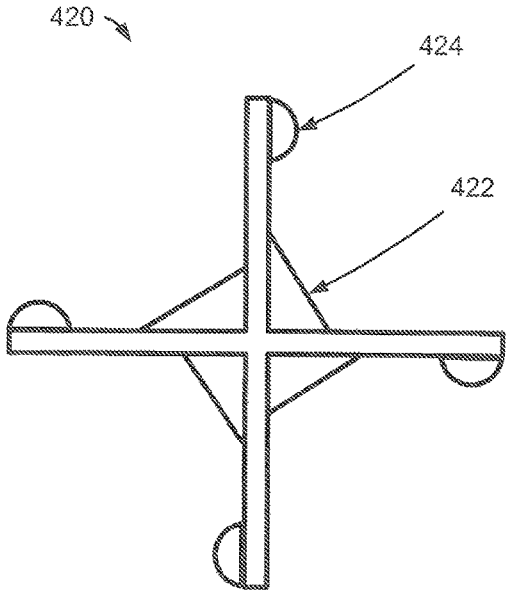

FIG. 4D illustrates an example separator 415 in which one or more radial ridges are formed with a plurality of portions or sections. For example, a radial ridge may include a first portion 416 positioned proximate to a spine of the separator 415, and a second portion 418 positioned proximate to a distal end or tip of a projection extending from the spine. As shown, each of the portions of a radial ridge may having a tapering thickness. In this regard, one or more desired separation distances (e.g., separation between adjacent sets of twisted pairs, separation between twisted pairs and an outer wrap, etc.) may be provided by the radial ridges while reducing an amount of utilized material. FIG. 4E illustrates another example separator 420 in which one or more radial ridges are formed with a plurality of portions or sections. Additionally, the sections of a radial ridge may be formed with different thickness variations. As shown, a radial ridge may have a first portion 422 that tapers as it extends away from a spine. The radial ridge may then have a second portion 424 that tapers in two direction in order to form a semi-circular thickness variation. For example, the radial ridge portion 424 may be formed as a hemispherical bulge that provides separation. A wide variety of other thickness variations may be utilized for multiple portions of a radial ridge as desired in various embodiments. Indeed, radial ridges and portions thereof may be formed with any suitable thickness combinations.

Figure 4F:
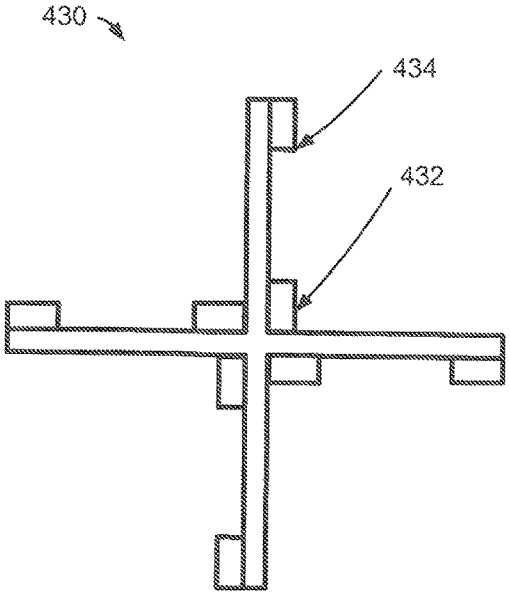
Figure 4G:
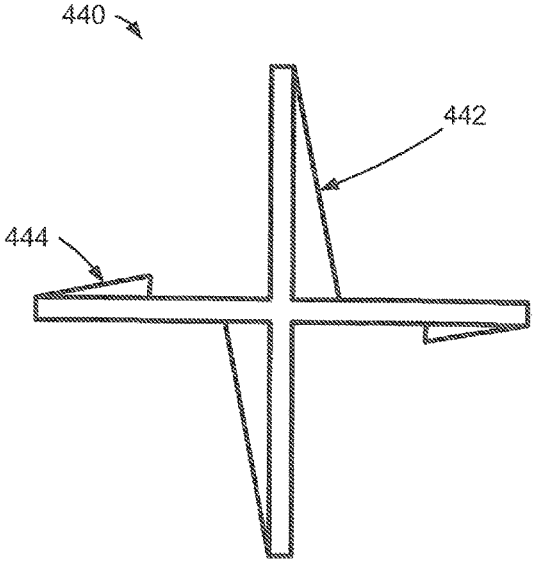

FIG. 4F illustrates another example separator 430 in which one or more radial ridges are formed with a plurality of portions or sections. As shown, each of the portions of a radial ridge may have a relatively uniform thickness. In certain embodiments, all of the portions of a radial ridge may have an approximately equal thickness. In other embodiments, a first portion 432 of a radial ridge may have a first thickness while a second portion 434 of the radial ridge may have a second thickness different than the first thickness. For example, the first thickness may facilitate a desired separation between adjacent sets of twisted pairs while the second thickness facilitates a desired separation between the twisted pairs and an outer wrap. FIG. 4G illustrates an example separator 440 in which different radial ridges are formed with different distances of radial extension. For example, a first radial ridge 442 formed on a first projection may extend approximately across an entire radial distance of the projection. However, a second radial ridge 444 formed on a second projection may partially extend across a radial distance of the projection. As desired, each of the radial ridges 442, 444 may include any number of portions and/or dimensions (e.g., thickness, varied thicknesses, cross-sectional shapes, distances of radial extension, etc.). Indeed, as shown in FIGS. 4A-4G, a wide variety of suitable radial ridges and/or combinations of radial ridges may be incorporated into separators.

The separators illustrated and described above with reference to FIGS. 4A-4G are provided by way of non-limiting example only. A wide variety of other separator constructions may be utilized as desired in various embodiments. Separators may be formed with any suitable arrangement of projections and/or radial ridges. The components of a separator, such as a spine, any of the projections, and/or any of the radial ridges, may also be formed with a wide variety of suitable dimensions and/or from a wide variety of suitable materials. As desired, any of the separator features discussed above may be combined in any suitable combination to form a separator.

Figure 5A:
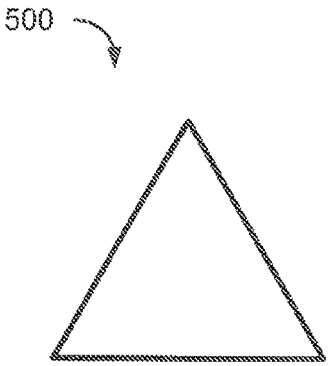
FIGS. 5A-5D are cross-sectional views of example radial ridges that may be incorporated into separators in accordance with various embodiments of the disclosure.
Figure 5B:
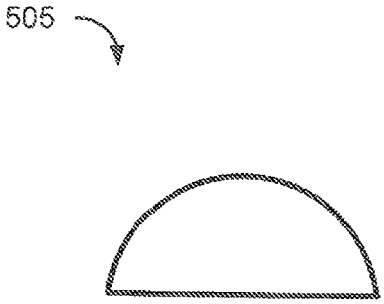
Figure 5C:
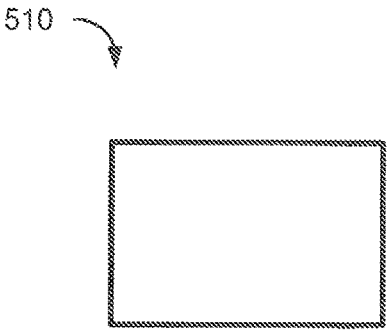
Figure 5D:
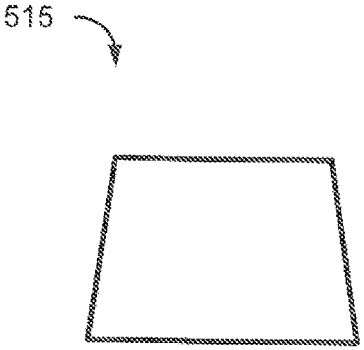

As set forth above, a radial ridge (e.g., such as radial ridge 120) or a portion of a radial ridge may be formed with a wide variety of suitable dimensions, such as a wide variety of suitable widths or longitudinal distances, distances of radial extension or projection, thicknesses, and/or cross-sectional areas. FIGS. 5A-5D illustrate cross-sectional views of a few example radial ridges that may be utilized in accordance with various embodiments of the disclosure. Turning first to FIG. 5A, a first example radial ridge 500 having a triangular cross-sectional shape is illustrated. As the radial ridge 500 extends away from a surface of a projection, the radial ridge 500 may have a wider base portions that narrows as the radial ridge 500 comes to a point or approximate point. As desired, a thickness of triangular-shaped radial ridge (e.g., a height of the triangle, etc.) may be tapered or otherwise varied along a distance of radial extension. FIG. 5B illustrates a second example radial ridge 505 having a semicircular cross-sectional shape. FIG. 5C illustrates a third example radial ridge 510 having a rectangular cross-sectional shape. FIG. 5D illustrates a fourth example radial ridge 515 having a trapezoidal cross-sectional shape. As desired, the thickness of any of the radial ridges 505, 510, 515 illustrated in FIGS. 5B-5D may be tapered or otherwise varied along a distance of radial extension. Additionally, radial ridges having other suitable cross-sectional shapes may be utilized as desired in other embodiments. Regardless of the cross-sectional shape utilized for a radial ridge, a radial ridge may have any suitable width or longitudinal length, distance of radial extension, thickness, thickness variations, and/or other dimensions.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

a plurality of twisted pairs of individually insulated electrical conductors that extend along a longitudinal direction;

a separator comprising:

a longitudinally extending spine positioned between the plurality of twisted pairs; and a plurality of longitudinally spaced sets of projections extending from the spine, each set of projections comprising a plurality of projections that extend in respective directions between respective sets of adjacent twisted pairs, wherein each projection comprises a thickness that varies along the longitudinal direction as a result of a radial ridge formed on a surface of the projection and extending from the surface towards one of the plurality of twisted pairs, and wherein the radial ridge formed on at least one of the plurality of projections within a set of projections comprises a radial ridge that tapers along a radial direction perpendicular to the longitudinal direction; and a jacket formed around the twisted pairs and the separator.

2. The cable of claim 1, wherein the radial ridges formed on respective surfaces of the plurality of projections within a set of projections included in the plurality of longitudinally spaced sets of projections are arranged in a clockwise manner.

3. The cable of claim 1, wherein a distance between adjacent sets of projections is at least 0.5 cm.

4. The cable of claim 1, wherein each radial ridge formed on a set of projections comprises a radial ridge that tapers in a respective radial direction perpendicular to the longitudinal direction.

5. The cable of claim 1, wherein the radial ridge formed on at least one of the plurality of projections within a set of projections comprises a continuous radial ridge extending from a first end of the projection positioned proximate the spine to a second end of the projection distal to the spine.

6. A cable comprising:

a plurality of twisted pairs of individually insulated electrical conductors that extend along a longitudinal direction;

a cross-filler separator positioned between the plurality of twisted pairs, the separator comprising:

a longitudinally extending spine;

a plurality of projections extending from the spine, each projection included in the plurality of projections extending between a set of adjacent twisted pairs; and a plurality of longitudinally spaced radial ridges, each ridge extending from one of the plurality of projections towards one of the plurality of twisted pairs such that the projection comprises a variable thickness along the longitudinal direction, wherein at least one of the plurality of radial ridges comprises a radial ridge that tapers along a radial direction perpendicular to the longitudinal direction such that the at least one radial ridge comprises a variable thickness as it extends away from the respective projection; and a jacket formed around the twisted pairs and the separator.

7. The cable of claim 6, wherein the plurality of projections comprises a plurality of sets of longitudinally spaced projections, and wherein the plurality of longitudinally spaced radial ridges comprises at least one radial ridge formed on each projection in the plurality of sets of longitudinally spaced projections.

8. The cable of claim 6, wherein a distance between longitudinally adjacent radial ridges included in the plurality of longitudinally spaced radial ridges is at least 0.5 cm.

9. The cable of claim 6, wherein at least one radial ridge included in the plurality of longitudinally spaced radial ridges comprises a continuous radial ridge extending from a first end of a projection positioned proximate the spine to a second end of the projection distal to the spine.

10. The cable of claim 6, wherein the plurality of longitudinally spaced radial ridges comprises a respective radial ridge formed on each of the plurality of projections at a cross-sectional location along a longitudinal direction of the cable.

11. The cable of claim 10, wherein the radial ridges at the cross-sectional location are arranged in a clockwise manner.

12. A cable comprising:

a plurality of twisted pairs of individually insulated electrical conductors that extend along a longitudinal direction;

a separator positioned between the plurality of twisted pairs, the separator comprising:

a plurality of projections that each extend between a set of adjacent twisted pairs included in the plurality of twisted pairs, each projection included in the plurality of projections having two opposing surfaces with a first surface facing a first twisted pair in the set of adjacent twisted pairs and a second surface facing a second twisted pair in the set of adjacent twisted pairs; and a plurality of longitudinally spaced radial ridges, each ridge extending from only one of the two opposing surfaces of one of the plurality of projections towards one of the plurality of twisted pairs such that the projection comprises a variable thickness along the longitudinal direction, wherein, at any given cross-sectional location along the longitudinal direction, only a single one of the plurality of projections extends between any set of adjacent twisted pairs; and a jacket formed around the twisted pairs and the separator.

13. The cable of claim 12, wherein the plurality of projections comprises a plurality of sets of longitudinally spaced projections, and wherein the plurality of longitudinally spaced radial ridges comprises at least one radial ridge formed on each projection in the plurality of sets of longitudinally spaced projections.

14. The cable of claim 12, wherein a distance between longitudinally adjacent radial ridges included in the plurality of longitudinally spaced radial ridges is at least 0.5 cm.

15. The cable of claim 12, wherein at least one radial ridge included in the plurality of longitudinally spaced radial ridges comprises a tapered radial ridge.

16. The cable of claim 12, wherein the plurality of longitudinally spaced radial ridges comprises a respective radial ridge formed on each of the plurality of projections at a cross-sectional location along a longitudinal direction of the cable.

17. The cable of claim 16, wherein the radial ridges at the cross-sectional location are arranged in a clockwise manner.

* * * * *